United States Patent [19]

Strzalka

[11] 4,087,303

[45] May 2, 1978

[54] GLUE APPLICATOR

[76] Inventor: Marion W. Strzalka, P.O. Box 64, Big Bear, Calif. 91215

[21] Appl. No.: 654,287

[22] Filed: Feb. 2, 1976

[51] Int. Cl.[2] ..... B65C 11/04

[52] U.S. Cl. ..... 156/357; 93/56 PD; 118/2; 118/252; 156/578

[58] Field of Search ..... 156/356, 357, 203, 466, 156/578; 93/36 R, 56 PD; 118/252, 262, 2, 3

[56] References Cited

U.S. PATENT DOCUMENTS

| | | | |
|---|---|---|---|
| 1,983,547 | 12/1934 | Knowlton | 156/578 X |
| 2,528,657 | 11/1950 | Hobe | 118/262 X |
| 2,659,342 | 11/1953 | Taggart | 118/252 X |
| 2,726,629 | 12/1955 | Paulsen | 118/252 X |
| 2,876,731 | 3/1959 | Lopez et al. | 93/36 R X |
| 2,898,816 | 8/1959 | Keely | 156/357 UX |
| 3,107,182 | 10/1963 | Anderson et al. | 118/252 |
| 3,354,606 | 11/1967 | Miller et al. | 93/56 PD X |

*Primary Examiner*—David A. Simmons
*Attorney, Agent, or Firm*—Boniard I. Brown

[57] ABSTRACT

A glue applicator for applying glue to a work sheet, such as a carton flap, by passage of the sheet between a sheet support and an applicator roller to which glue is applied, preferably with the aid of a spreading roller in peripheral contact with the applicator roller, and which rolls a thin film of the glue onto the sheet. The glue applicator is particularly adapted for use on a carton sealing machine to apply glue to one folded flap of a flattened carton structure which is thereafter fed into the machine between feed rolls of the machine which compress the carton structure to bond the glue coated flap to a second overlying flap.

6 Claims, 9 Drawing Figures

32
106
11
108
114
35
62
5
52
44
36
60
28
96
82
34
38
18
66
102
110
112
88
61
84
86
94
92
90
50
40
46
42
48
58
104
56
54
100
7
6

GLUE APPLICATOR

BACKGROUND OF THE INVENTION

1. Field of the Invention

This invention relates generally to glue applicators and more particularly to a glue applicator for rolling a thin film of glue onto a work sheet, such as one folded flap of a flattened carton structure which is then fed into a carton sealing machine between feed rolls of the machine which compress the flattened carton structure to bond the glue coated flap to a second overlying flap.

2. Discussion of the Prior Art

As will appear from the ensuing description, the glue applicator of this invention may be used for various purposes. The applicator, however, is primarily intended for use on a particular type of carton sealing machine and will be described in this context.

The particular sealing machine referred to is a carton taping machine manufactured by the General Corrugated Machinery Co., Inc., of Palisades Park, N.J. Since this machine is conventional and need not be fully explained to understand the invention, only a brief description of the machine will be presented. The machine is adapted to receive flattened carton structures each having a generally rectangular panel with a fold line between and parallel to two opposite edges of the panel, and flaps hinged to the panel along these and the other panel edges. In the flattened condition of the carton structure the two flaps along the two mentioned parallel panel edges are folded inwardly against the same side of the panel with the outer edge portion of one flap, referred to as the outer flap, overlying the other edge portion of the other flap, referred to as the inner flap. The remaining flaps of the carton structure are unfolded and lie in the plane of the panel.

This flattened carton structure is fed edgewise into the machine between feed rolls which compress the structure to press its overlapping inner and outer flaps firmly together. As this compressed carton structure proceeds through the machine adhesive tapes or strips are applied to its overlapping flaps to firmly join the flaps after which the carton structure is erected to carton shape or otherwise handled.

A variety of glue applicators have been tried on carton sealing machines of the kind described. However, these existing applicators are not totally satisfactory, at least for the particular carton sealing machine described, for various reasons, foremost among which are that they apply a bead of glue which must be spread by the pressure exerted on the carton flaps to be glued and hence use excessive glue which not only is uneconomical but also frequently results in contamination of the sealing machine pressure rolls and other parts and requires a long drying time for the bonded surfaces. This long drying time, of course, reduces the carton through put rate of the carton machine.

SUMMARY OF THE INVENTION

This invention provides a glue applicator which may be used on the carton taping machine discussed above, referred to herein as a carton sealing machine, in place of the tape applying means of the machine to effect adhesive bonding rather than adhesive taping of the overlapping inner and outer carton flaps to one another. The glue applicator has a work or carton support to be located in the infeed path of the flattened carton structure to the carton machine for entrance between the folded flaps and panel of the carton structure. This support supports the inner carton flap substantially in its folded position and supports the outer carton flap in a partially folded position to expose the outer edge portion of the inner flap normally overlapped by the outer flap. Means are provided for mounting the support on the carton handling machine in the infeed path of the flattened carton structures and spaced from the infeed rolls of the machine a distance such that the carton flaps may be returned to their folded positions during movement of the carton structure from the support to the infeed rolls for passage of the carton structure in its flattened condition between the rolls.

Mounted on the carton support is an applicator roller whose surface may be pitted to provide a myriad of glue recesses and which engages the outer edge portion of the inner carton flap during movement of the latter across the support. Means are provided for applying glue to this roller as the inner flap passes the roller in such a way that the roller rolls a thin film of glue onto the flap. According to the described embodiment, the glue is applied to the applicator roller by a distributor roller which rolls against the applicator roller and which is fed with glue from a bottle or the like in a manner such that the distributor roller applies a relatively thin and even layer of glue to the applicator roller. Glue flow to the distributor roller is controlled by a valve actuated by each flattened carton structure fed to the glue applicator. After emerging from the applicator, the carton structure is restored to its flattened condition and enters the sealing machine wherein the feed rolls compress the structure to firmly bond the overlapping inner and outer flaps to one another.

The glue applicator is adjustable to accommodate a range of flap thicknesses and to locate the applicator in the proper position relative to the carton sealing machine. As noted earlier, while the applicator is intended primarily for use on the described carton machine, it may be used for other purposes. In this regard, it will be understood that the applicator may be used to roll a thin layer of glue onto a variety of thin sheet-like work pieces, referred to herein simply as work sheets.

DESCRIPTION OF THE PREFERRED EMBODIMENT

Figures 1, 2:
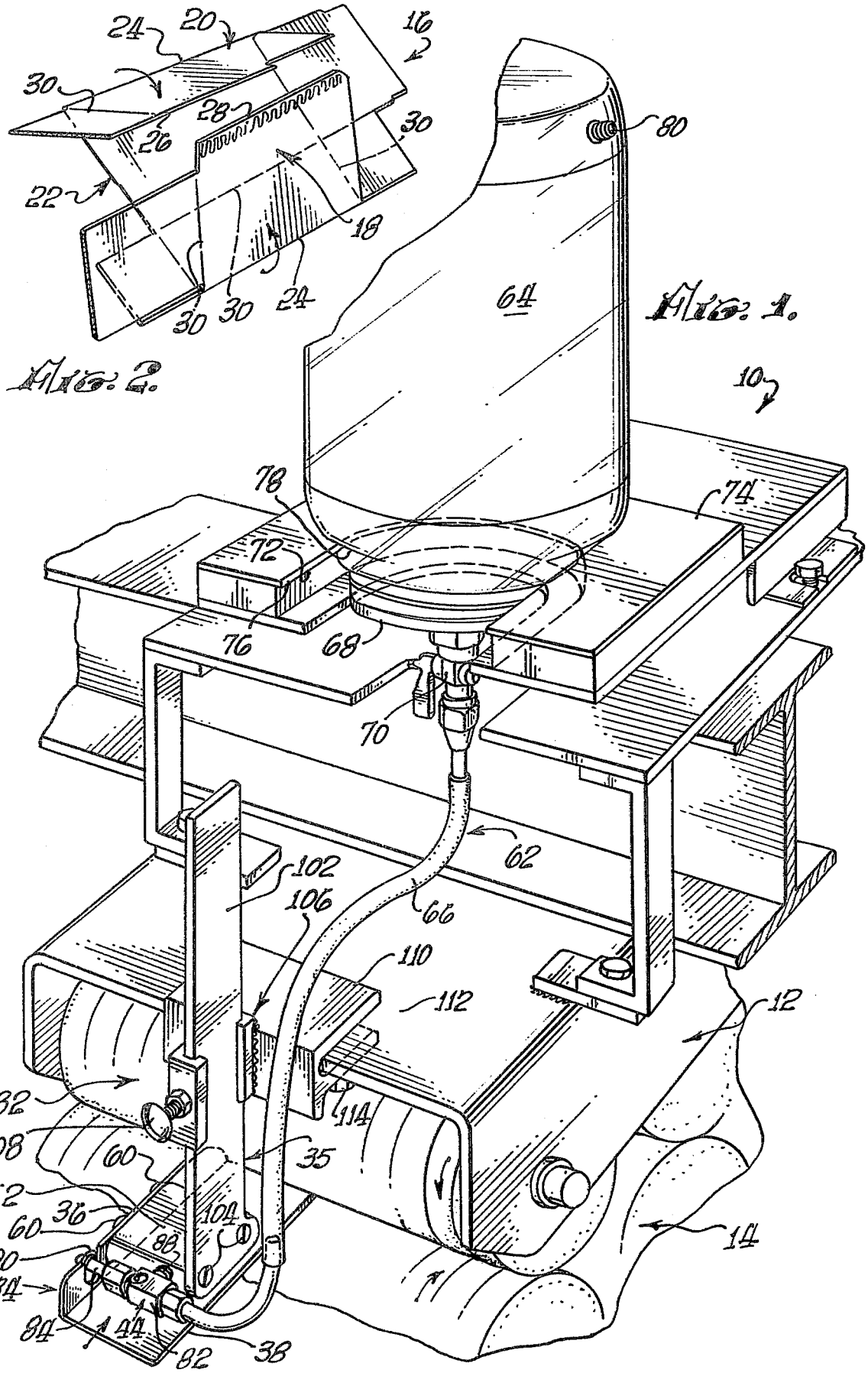
FIG. 1 is a perspective view of a glue applicator according to the invention mounted on a carton sealing machine of the character described.
FIG. 2 is a perspective view of the carton structure which the machine handles.

Referring first to FIG. 1, there is illustrated, in fragmentary fashion, a carton taping or sealing machine 10 of the kind mentioned earlier. As noted, this machine is conventional and its full details are not essential to an understanding of the invention and accordingly need not be described in elaborate detail. Suffice it to say that the machine has a frame 12 mounting feed rolls 14 for feeding through the machine, in the direction of the arrow in FIG. 1, flattened carton structures having overlapping inner and outer flaps which are sealed together in the machine. One of these carton structures is shown at 16 in FIG. 2 in partially unfolded condition.

Turning to FIG. 2, carton structure 16 comprises a corrugated cardboard sheet which is trimmed to the illustrated outline shape and scored along the illustrated broken lines to provide fold lines about which the sheet may be folded to erect the carton structure into a finished carton configuration. An initial step in this erection procedure involves folding of two end portions 18 and 20 of the sheet inwardly toward one another and downwardly against the central portion 22 of the sheet, as indicated in FIG. 2 by the arrows A, about fold lines 24 of the sheet. In this initial folded condition, the carton structure is essentially a flattened carton structure whose central portion 22 forms a panel and whose end portions 18, 20 form flaps which are folded against the panel. When thus folded, the outer edge portion 26 of end portion or flap 20 overlies or overlaps the outer edge portion 28 of end portion or flap 18. For this reason, flap 18 is referred to herein as an inner flap and flap 20 as an outer flap.

The next step in forming the carton structure 16 into a finished carton configuration involves sealing or joining the flaps 18, 20 to one another to form essentially a flattened tubular structure. Thereafter, the carton structure is finally erected by folding the structure about its various fold lines to its finished carton configuration. The present invention is concerned only with joining the flaps 18, 20 and hence an elaborate description of the entire carton structure and its complete erection procedure is unnecessary. Suffice it to say that in addition to the fold lines 24, the carton structure has other fold lines, designated for simplicity by the same reference numeral 30, about which the structure is foldable to its final carton configuration.

As noted, the present invention is concerned only with joining or sealing the flaps 18, 20 of the flattened carton structure 16. The particular carton sealing machine 10 illustrated is of the type discussed earlier which was originally designed to accomplish this flap sealing function by taping the flaps together. According to the present invention, as applied to this particular machine, the taping means (not shown) of the machine are removed, leaving the remainder of the machine including its feed rolls 14, intact and the present glue applicator 32 is installed on the machine. As explained in more detail later, this glue applicator rolls a thin film of glue onto the outer edge portion 28 of the inner carton flap 18, after which the outer flap 20 is folded against the inner flap of the flattened carton structure which is fed into the machine between its feed rolls 14 to effect adhesive bonding of the outer edge portion 26 of the outer flap to the adhesively coated outer edge portion 28 of the inner flap. Glue applicator 32 will now be described by reference to FIGS. 1 and 3–9.

Broadly speaking, the glue applicator 32 comprises a work or carton support 34 mounted by means 35 on the carton sealing machine 10 in the infeed path of the flattened carton structures 16 to the machine. This work or carton support has means 36 for entrance between the panel 22 and outer flap 20 of each carton structure to partially unfold the outer flap from contact with the inner flap 18 and thereby expose the outer edge portion 28 of the inner flap, and means 38 for entrance between the panel and the inner flap to support the latter flap for edgewise movement along the infeed path of the carton structure. In the particular glue applicator shown, the carton support 34 is fabricated from sheet metal which is bent at right angles adjacent one edge to provide the sheet metal support with a relatively wide platen-like portion which forms the inner flap supporting means 38 and an upstanding flange along one edge of the platen which forms the outer flap supporting means 36.

Rotatably mounted on the carton support 34 to turn on an axis normal to the outer flap supporting flange 36 and parallel to the inner flap supporting platen 38 is a glue applicator roller 40. This roller overlies the platen 38 in spaced generally parallel relation thereto for passage of the outer edge portion 28 of the inner carton flap 18 between the roller and platen with the upper surface of said edge portion in contact with the roller. Means 42 are provided for applying glue to this applicator roller in such a way that the roller rolls a thin film of glue onto the outer flap portion 28 during movement of the inner carton flap 18 past the roller. Glue flow to the applicator roller 40 is controlled by a normally closed shutoff valve 44 which is actuated to its open position by the inner carton flap as the latter approaches the roller.

Figures 3, 4, 5, 6, 7, 8, 9:
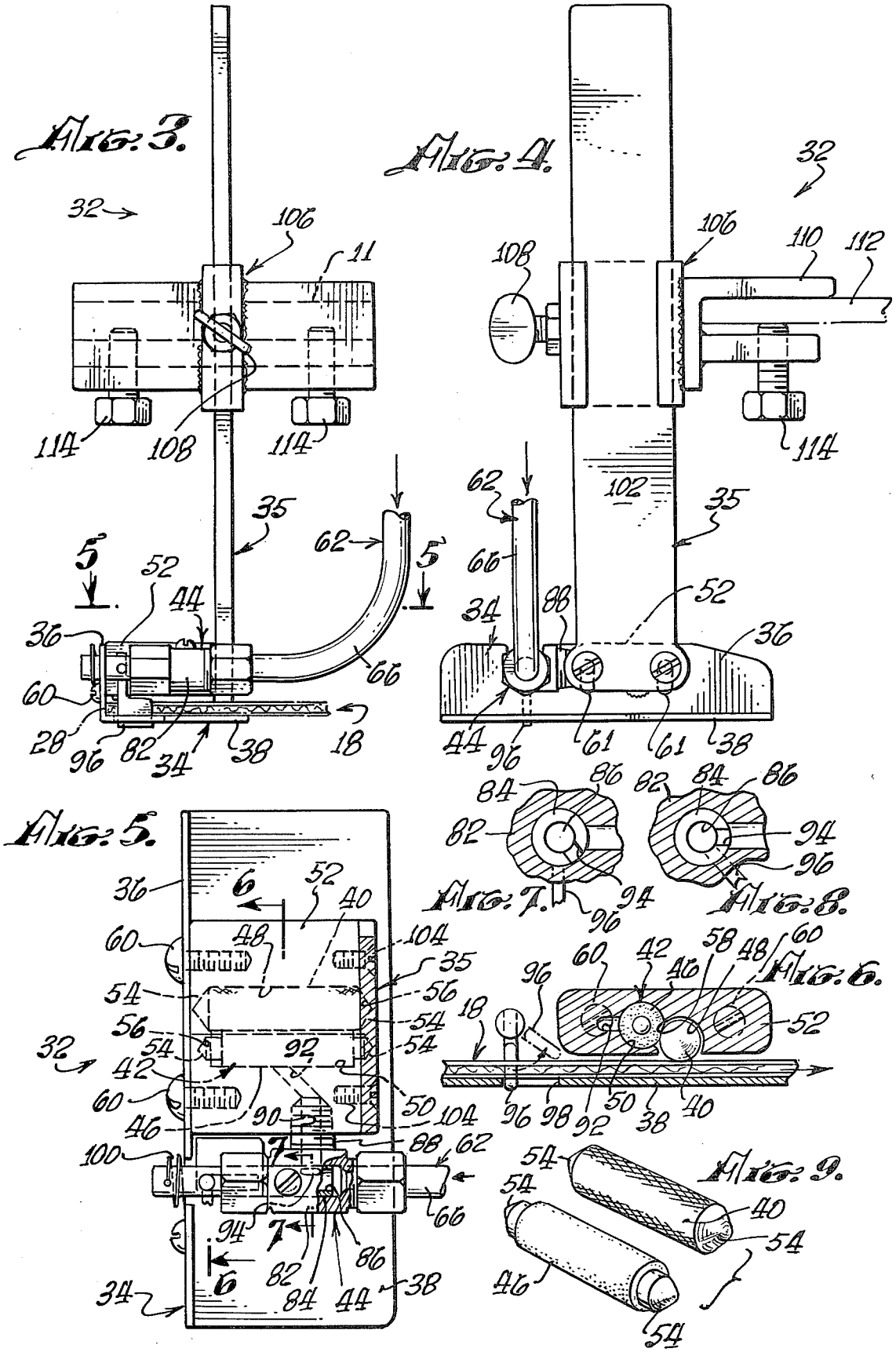
FIG. 3 is a front view of the glue applicator.
FIG. 4 is a side view of the applicator.
FIG. 5 is a section taken on line 5—5 in FIG. 3.
FIG. 6 is a section taken on line 6—6 in FIG. 5.
FIGS. 7 and 8 are sections taken along line 7—7 in FIG. 5 through a glue valve showing the valve in its open a closed positions.
FIG. 9 is a perspective view of two glue rollers of the applicator.

The means 42 for applying glue to the applicator roller 40 comprises a glue spreading roller 46 disposed in peripheral contact with the applicator roller. Rollers 40 and 46 are disposed within parallel, laterally communicating bores 48, 50, respectively, within a block 52 with a relatively small clearance on the order of 1/64 inch between the rollers and the walls of the bores. As shown in FIG. 5, the rollers have conical ends 54 which engage in conical bearing sockets 56 in the block 52 at the ends of the bores 48, 50 to rotatably support the rollers for turning on the axis of the bores. The rollers are disposed in peripheral contact through the communicating opening 58 between the bores.

The glue applicator roller bore 48 opens through the underside of the roller block 52 toward the inner flap supporting platen 38. Glue applicator roller 40 protrudes through this open side of the bore for contact with the inner carton flap 18 moving past the roller, as shown in FIG. 6. Roller block 52 is attached at one end to the outer carton flap supporting flange 34 by screws 60 which pass through slots 61 in the flange to permit adjustment of the block and thereby the applicator roller 40 toward and away from the platen 38 for adjusting the clearance space between roller and platen for accommodating a range of carton flap thicknesses.

Glue applying means 42 further comprises means 62 for feeding glue to the spreading roller 46. This glue feeding means comprises a glue container 64 mounted atop the sealing machine frame 12 and a tube 66 for conveying glue from the container to the glue feed valve 44. The particular container shown is a bottle with a removable cap 68 mounting a valve 70 to which the glue tube 66 connects. The glue bottle is mounted in an inverted position by engagement of its cap 68 and neck within a slot 72 in a bottle mounting plate 74 attached to the top of the machine frame 12. About the slot 72 is a projecting flange 76 which engages within a peripheral groove or recess 78 about the bottle neck to hold the glue bottle in its inverted position, whereby glue gravitates from the bottle to the glue feed valve 44. The glue bottle 64 has a vent 80 to permit this gravitation of the glue to the valve.

Glue feed valve 44 comprises a body 82 rotatably receiving a tubular valve spindle 84, one end of which extends beyond one end of the body. Glue tube 66 connects to the other end of the body for feeding glue to the interior passage 86 through the valve spindle 84. Valve body 82 is connected to the glue roller block 52 by a threaded nipple 88. Extending from the valve spindle bore 90 in the valve body 82, through the body, the nipple 88 and the glue roller block 52 to the spreading roller bore 50 in the block is a glue passage 92. Valve spindle 84 contains a port 94 and is rotatable between a closed position (FIG. 7) wherein the port is blocked by the valve body 82 to block glue flow to the spreading roller 46 and an open position (FIG. 8) wherein the port registers with the passage 92 to permit glue flow to the roller.

As noted earlier, the glue feed valve 44 is operable between its open and closed positions in response to movement of a carton structure 16 past the glue applicator. To this end, the extending end of the valve spindle 84 mounts a vane 96 which projects radially of the spindle into the path of the inner carton flap 18 through the glue applicator. The flap supporting platen 38 has a clearance opening 98 for this vane. When the valve is closed, this vane extends across the flap path and rests against one edge of the clearance opening, as shown in full lines in FIG. 6. The valve spindle 84 is urged to this closed position by a spring 100. During its infeed movement through the glue applicator, the inner carton flap 18 engages the valve vane 96 and rotates the latter and thereby the valve spindle to open position, shown in broken lines in FIG. 6. The spring 100 returns the valve spindle to closed position upon disengagement of the carton flap from the vane.

As noted earlier, the glue applicator is attached to the carton sealing machine 10 by mounting means 35. This mounting means comprises an upright bar 102 which is rigidly secured at its lower end by screws 104 to the outer side of the glue roller block 52, that is the side of this block opposite the carton support flange 36. Slidable on the bar 102 is a mounting bracket 106 having a set screw 108 for securing the bracket to the arm. Extending laterally of the arm is a fork 110 on the bracket adapted to straddle an upper plate 112 of the sealing machine frame 12 located over the two first or infeed rolls 14 of the machine. This fork has set screws 114 for securing the mounting bracket 106 and hence the entire glue applicator, to the frame. The mounting means 35 thus permits vertical unitary adjustment of the carton support 34 and the glue rollers 40, 46 relative to the sealing machine 10.

In operation of the carton sealing machine 10 and glue applicator 32, a flattened carton structure 16 is fed to the machine past the applicator in such a way that the carton flap support flange 36 enters between the carton structure panel 22 and outer flap 20 to separate the latter from the inner flap 18 and the flap support platen 38 enters between the panel and the inner flap to support the latter for edgewise movement past the glue applicator roller 40. As the inner flap enters onto the platen, the flap engages the glue feed valve spindle vane 96 and rotates the valve spindle 84 to open position and thereby effect glue flow to the applicator spreading roller 46.

During its movement past the glue applicator roller 40, the inner carton flap 18 engages and rotates the roller which, in turn, rotates the spreading roller 46. As this latter roller turns, it receives glue entering through the glue feed passage 92 and rolls a film or thin layer of glue onto the applicator roller 40. This roller, in turn, rolls a thin film of glue onto the outer edge portion 28 of the inner carton flap. As the carton structure emerges from the glue applicator, its outer flap 20 is refolded against the inner flap and the reflattened glue coated structure is fed between the feed rolls 14 of the sealing machine 10. These rolls compress the flattened carton structure to retain its flaps 18, 20 in firm bonding contact sufficiently long for the glue to set. The glued carton structure is then erected to its final carton shape, as explained earlier.

In connection with the above operation, it will be understood that the glue applicator is located relative to the machine 10 to permit feeding of a carton structure 16 from the applicator to the machine in the manner explained. It will be understood, therefore, that the applicator carton support 34 is spaced sufficiently from, that is located sufficiently in advance of the first or infeed rolls 14 of the machine to enable folding of the outer carton flap 20 against the inner flap 18 prior to entrance of the structure between the rolls. This folding operation may be aided or accomplished by hand or by means on the machine, if necessary.

A variety of applicator and spreading rollers 40, 46 may be used in the glue applicator. Preferably, the applicator roller is a serrated roller having a myriad of glue recesses or cavities in its surface and the spreading roller is a resilient roller in firm peripheral contact with the applicator roller.

The inventor claims:

1. A glue applicator for a carton sealing machine of the character described for receiving along an infeed path to the machine a flattened carton structure having a rectangular panel and inner and outer flaps hinged along opposite edges of said panel and disposed in folded positions wherein said flaps are folded against one side of said panel with the outer edge portion of said outer flap overlying the outer edge portion of said inner flap, and the machine comprising a pair of infeed rolls at opposite sides of said path for compressing the flattened carton structure between the rolls, said glue applicator comprising:

a carton support to be located along said infeed path comprising a thin flanged plate including a relatively wide normally horizontal portion forming a platen for entrance between said carton panel and inner flap to support said inner flap substantially in its folded position, and an upstanding flange along one edge of said platen for entrance between said panel and outer flap to support said outer flap in a partially unfolded position wherein the outer flap is separated from the inner flap to expose said edge portion of said inner flap, a block extending from said flange over said platen to overlie said inner flap with the normally under side of said block facing said platen, said block containing two laterally communicating bores on parallel axes normally to said flange and parallel to said platen, one bore opening laterally through the under side of said block toward said platen, an applicator roller rotatable in said one bore and protruding through the open side of the latter bore toward said platen for contact with said edge portion of said inner flap during movement of said inner flap along said platen, means adjustably securing said block to said flange for adjustment of said block toward and away from said platen to adjust the spacing between said roller and platen, a spreading roller rotatable in the other bore of said block and disposed in peripheral contact with said applicator roller through the communicating opening between said bores, means including valve means operable by said carton structure for feeding glue to said spreading roller during movement of said carton structure past said support, whereby said spreading roller applies said glue to said applicator roller and the latter roller rolls a thin film of glue onto said inner flap edge portion during movement of said inner flap past said applicator roller, and means for adjustably mounting said support on said machine with said platen parallel to a plane passing between and tangent to said infeed rolls and with said support spaced from said infeed rolls a distance such that said flaps are returnable to their fully folded positions during movement of the carton structure from said support to said infeed rolls for entrance of the carton structure in its fully flattened condition between the infeed rolls.

2. A glue applicator for a carton sealing machine comprising:

a thin flanged plate having a relatively wide normally horizontal portion forming a platen for supporting carton flaps for edgewise movement along the platen and an upstanding flange along one edge of the platen, a block extending from said flange over said platen to overlie said inner flap with the normally under side of said block facing said platen, said block containing two laterally communicating bores on parallel axes normal to said flange and parallel to said platen, one bore opening laterally through the under side of said block toward said platen, an applicator roller rotatable in said one bore and protruding through the open side of the latter bore toward said platen for contact with said carton flaps, means adjustably securing said block to said flange for adjustment of said block toward and away from said platen, a spreading roller rotatable in the other bore of said block and disposed in peripheral contact with said applicator roller through the communicating opening between said bores.

3. A glue applicator according to claim 2 including valve means operable by said carton structure for feeding glue to said spreading roller during movement of said carton structure past said support, whereby said spreading roller applies said glue to said applicator roller and the latter roller rolls a thin film of glue onto said inner flap edge portion during movement of said inner flap past said applicator roller.

4. A glue applicator according to claim 3 wherein:

said valve means comprises a valve body on said block containing a valve bore normal to said flange and parallel to said platen, a valve spindle rotatable in said bore between open and closed positions, a spring for biasing said spindle to closed position, and means on said spindle engageable by each carton flap for rotating said spindle against open position as the flap travels past said applicator roller.

5. A glue applicator according to claim 1 wherein:

said valve means comprises a valbe body on said block containing a valve bore normal to said flange and parallel to said platen, a valve spindle rotatable in said bore between open and closed positions, a spring for biasing said spindle to closed position, and means on said spindle engageable by each inner carton flap for rotating said spindle against open position as the flap travels past said applicator roller.

6. A glue applicator according to claim 1 wherein:

said adjustable mounting means comprises an upright mounting bar fixed to the end of said block opposite said flange, and a bracket slidably receiving said bar and adapted for attachment to said machine.

* * * * *